US010546536B2

(12) United States Patent
Kim et al.

(10) Patent No.: US 10,546,536 B2
(45) Date of Patent: Jan. 28, 2020

(54) STAGE AND ORGANIC LIGHT EMITTING DISPLAY DEVICE USING THE SAME

(71) Applicant: SAMSUNG DISPLAY CO., LTD., Yongin-si, Gyeonggi-do (KR)

(72) Inventors: Sung Hwan Kim, Yongin-si (KR); Jun Hyun Park, Yongin-si (KR); Kyoung Ju Shin, Yongin-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 395 days.

(21) Appl. No.: 15/626,305

(22) Filed: Jun. 19, 2017

(65) Prior Publication Data

US 2018/0005573 A1 Jan. 4, 2018

(30) Foreign Application Priority Data

Jun. 30, 2016 (KR) ..... 10-2016-0082656

(51) Int. Cl.
*G09G 3/3266* (2016.01)

(52) U.S. Cl.
CPC ... *G09G 3/3266* (2013.01); *G09G 2310/0286* (2013.01)

(58) Field of Classification Search
CPC ..... G09G 3/30–3291; G09G 2310/0286
See application file for complete search history.

(56) References Cited

U.S. PATENT DOCUMENTS 8,542,225 B2 * 9/2013 Han ..... H03K 3/356139 345/208
8,717,257 B2 * 5/2014 Kim ..... G09G 3/3233 315/169.3
8,786,591 B2 * 7/2014 Park ..... G09G 3/3233 345/212
9,343,011 B2 * 5/2016 Yang ..... G09G 3/3233
9,368,069 B2 * 6/2016 Woo ..... G09G 3/3266
9,412,306 B2 * 8/2016 Kim ..... G09G 3/3208
9,443,464 B2 * 9/2016 Song ..... G09G 3/3266
9,454,934 B2 * 9/2016 Woo ..... G09G 3/3266
(Continued)

FOREIGN PATENT DOCUMENTS

KR 10-2012-0077792 7/2012
KR 10-2013-0143318 12/2013
(Continued)

*Primary Examiner* — Patrick F Marinelli
(74) *Attorney, Agent, or Firm* — Kile Park Reed & Houtteman PLLC

(57) ABSTRACT

A stage includes first, second, and third outputs and first and second signal processors. The first output supplies a scan signal to a first output terminal based on signals to first and second input terminals and the voltage of a first node. The second output is connected to a first power source and supplies an emission control signal to a second output terminal based on signals to the first input terminal, the first output terminal, and a third input terminal. The third output is connected to the first power source and supplies an inverted emission control signal to a third output terminal based on signals to the first input terminal and second output terminal. The first signal processor controls the first node voltage based on a signal to a fourth input terminal. The second signal processor controls the first node voltage based on the signal to the second input terminal.

20 Claims, 5 Drawing Sheets

(56) References Cited

U.S. PATENT DOCUMENTS 9,454,935 B2 * 9/2016 Park ..... G09G 3/3233
9,501,970 B2 * 11/2016 Park ..... G09G 3/3233
9,524,675 B2 * 12/2016 Wei ..... G09G 3/3233
9,620,063 B2 * 4/2017 Kim ..... G09G 3/3266
9,646,535 B2 * 5/2017 Yoon ..... G09G 3/3233
9,830,850 B2 * 11/2017 Sun ..... G09G 3/20
10,013,919 B2 * 7/2018 Yang ..... G09G 3/3266
10,019,949 B2 * 7/2018 Ma ..... G11C 19/28
10,204,544 B2 * 2/2019 Kim ..... G09G 3/2092
10,255,860 B2 * 4/2019 Na ..... G09G 3/3266
2005/0285827 A1 * 12/2005 Eom ..... G09G 3/3233 345/76
2010/0207968 A1 * 8/2010 Kim ..... G09G 3/3266 345/691
2011/0041020 A1 * 2/2011 Liu ..... G01R 31/31853 714/731
2011/0102398 A1 * 5/2011 Han ..... H03K 3/356139 345/209
2012/0038683 A1 * 2/2012 Park ..... G09G 3/3233 345/690
2012/0062525 A1 * 3/2012 Kim ..... G09G 3/3233 345/204
2013/0069854 A1 * 3/2013 Park ..... G09G 3/3233 345/82
2014/0062843 A1 * 3/2014 Yang ..... G09G 3/3233 345/76
2014/0132162 A1 * 5/2014 Kim ..... G09G 3/3266 315/161
2015/0015554 A1 * 1/2015 Kim ..... G09G 3/3208 345/208
2015/0138180 A1 * 5/2015 Park ..... G09G 3/3233 345/212
2015/0356913 A1 * 12/2015 Kim ..... G09G 3/3266 345/215
2017/0206824 A1 * 7/2017 Sun ..... G09G 3/20
2017/0323593 A1 * 11/2017 Kim ..... G09G 3/2092
2018/0005573 A1 * 1/2018 Kim ..... G09G 3/3275
2018/0137808 A1 * 5/2018 Na ..... G09G 3/3266
2018/0174553 A1 * 6/2018 Bong ..... G09G 3/20
2019/0206311 A1 * 7/2019 Yu ..... G09G 3/3208

FOREIGN PATENT DOCUMENTS

KR 10-2015-0016706 2/2015
KR 10-2015-0025539 3/2015
KR 10-2015-0037438 4/2015

* cited by examiner

STAGE AND ORGANIC LIGHT EMITTING DISPLAY DEVICE USING THE SAME

CROSS-REFERENCE TO RELATED APPLICATION

Korean Patent Application No. 10-2016-0082656, filed on Jun. 30, 2016, and entitled, "Stage and Organic Light Emitting Display Device Using the Same," is incorporated by reference herein in its entirety.

BACKGROUND

1. Field

One or more embodiments described herein relate to a stage and an organic light emitting display device using a stage.

2. Description of the Related Art

A variety of displays have been developed. Examples include liquid crystal displays and organic light emitting displays. An organic light emitting display generates an image based on light emitted from an organic light emitting diode in each pixel. The light is generated based on a recombination of electrons and holes in an active layer of the diode. Such a display has high response speed and low power consumption.

In operation, a data driver supplies data signals to data lines, a scan driver supplies a scan signal to scan lines, an emission driver supplies an emission control signal to emission control lines. The data lines, scan lines, and emission control lines are connected to the pixels.

The pixels are selected when a scan signal is supplied to the scan line. The selected pixels then receive data signals from the data lines. Light emitted from the pixels have luminances based on the data signals. The emission time of the pixels are controlled by the emission control signal from the emission driver.

The scan lines and emission control lines may be driven by different stages. As a result, dead space is increased. For example, a stage for driving the scan lines and a stage for driving the emission control lines are mounted in a panel. This may increase dead space. Also, the stages for driving the scan lines and emission control lines include a plurality of transistors and a plurality of capacitors. This increases circuit complexity and power consumption. Also, the stages for driving the scan lines and the emission control lines are driven by a plurality of signal lines, which further increases dead space and power consumption.

SUMMARY

In accordance with one or more embodiments, a stage including a first output to supply a scan signal to a first output terminal based on a signal supplied to a first input terminal, a signal supplied to a second input terminal, and a voltage of a first node; a second output, connected to a first power source, to supply an emission control signal to a second output terminal based on signals supplied to the first input terminal, the first output terminal, and a third input terminal; a third output, connected to the first power source, to supply an inverted emission control signal to a third output terminal based on signals supplied to the first input terminal and the second output terminal; a first signal processor to control a voltage of the first node based on a signal supplied to a fourth input terminal; and a second signal processor to control the voltage of the first node based on the signal supplied to the second input terminal. The first power source may be set with a gate off voltage.

The first input terminal may receive a first clock signal, and the emission control signal may have a width of one or more periods of the first clock signal. The scan signal may have a width less than one period of the first clock signal and is to have a gate-on voltage. The inverted emission control signal may have an inverted form of the emission control signal. When the emission control signal has a gate-off voltage, the inverted emission control signal may have a gate-on voltage.

The second input terminal may receive an emission control signal of a next stage, the third input terminal may receive an emission start signal or an inverted emission control signal of a previous stage, and the fourth input terminal may receive a scan start signal or a scan signal of a previous stage.

The first output may include a first transistor connected between the first input terminal and the first output terminal, the first transistor including a gate electrode connected to the first node; a second transistor connected between the first output terminal and the first power source, the second transistor including a gate electrode connected to the second input terminal; and a first capacitor connected between the first node and the first output terminal.

The second output may include a third transistor connected between the first output terminal and the second output terminal, the third transistor including a gate electrode connected to the first output terminal; and a fourth transistor and a fifth transistor serially connected between the second output terminal and the first power source, a gate electrode of the fourth transistor is connected to the third input terminal, and a gate electrode of the fifth transistor is connected to the first input terminal.

The third output may include a sixth transistor connected between the first input terminal and the third output terminal, the sixth transistor including a gate electrode connected to the first input terminal; a seventh transistor connected between the third output terminal and the first power source, the seventh transistor including a gate electrode connected to the second output terminal; and a second capacitor connected between the third output terminal and the first power source.

The first signal processor may include an eighth transistor connected between the fourth input terminal and the first node, and the eighth transistor may include a gate electrode connected to the fourth input terminal. The second signal processor may include a ninth transistor connected between the first node and the first power source, and the ninth transistor may include a gate electrode connected to the second input terminal. Each of the first output, the second output, the third output, the first signal processor, and the second signal processor may include at least one NMOS transistor.

In accordance with one or more other embodiments, an organic light emitting display device includes a plurality of pixels connected with scan lines, data lines, and emission control lines; a data driver to supply data signals to the data lines; and a gate driver including a plurality of stages to supply a scan signal to the scan lines and an emission control signal to the emission control lines. Each of the stages include a first output to supply a scan signal to a first output terminal based on a signal supplied to a first input terminal, a signal supplied to a second input terminal, and a voltage of a first node; a second output, connected to a first power source, to supply an emission control signal to a second output terminal based on signals supplied to the first input terminal, the first output terminal, and a third input terminal; a third output, connected to the first power source, to supply an inverted emission control signal to a third output terminal based on signals supplied to the first input terminal and the second output terminal; a first signal processor to control a voltage of the first node based on a signal supplied to a fourth input terminal; and a second signal processor to control the voltage of the first node based on the signal supplied to the second input terminal, and wherein the first power source is to have a gate-off voltage.

A first clock signal may be supplied to the first input terminals of the stages in one or more odd numbered horizontal lines, and a second clock signal may be supplied to the first input terminals of stages in one or more even numbered horizontal lines. The first clock signal and second clock signal may have a same period and inverted phases.

The second input terminal may receive an emission control signal of a next stage, the third input terminal may receive an emission start signal or an inverted emission control signal of a previous stage, and the fourth input terminal may receive a scan start signal or a scan signal of a previous stage.

The first output may include a first transistor connected between the first input terminal and the first output terminal, the first transistor including a gate electrode connected to the first node; a second transistor connected between the first output terminal and the first power source, the second transistor including a gate electrode connected to the second input terminal; and a first capacitor connected between the first node and the first output terminal.

The second output may include a third transistor connected between the first output terminal and the second output terminal, the third transistor including a gate electrode connected to the first output terminal; and a fourth transistor and a fifth transistor serially connected between the second output terminal and the first power source, a gate electrode of the fourth transistor is connected to the third input terminal, and a gate electrode of the fifth transistor is connected to the first input terminal.

The third output may include a sixth transistor connected between the first input terminal and the third output terminal, the sixth transistor including a gate electrode connected to the first input terminal; a seventh transistor connected between the third output terminal and the first power source, the seventh transistor including a gate electrode connected to the second output terminal; and a second capacitor connected between the third output terminal and the first power source.

The first signal processor may include an eighth transistor connected between the fourth input terminal and the first node, the eighth transistor including a gate electrode connected to the fourth input terminal, and the second signal processor may include a ninth transistor connected between the first node and the first power source, the ninth transistor including a gate electrode connected to the second input terminal.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
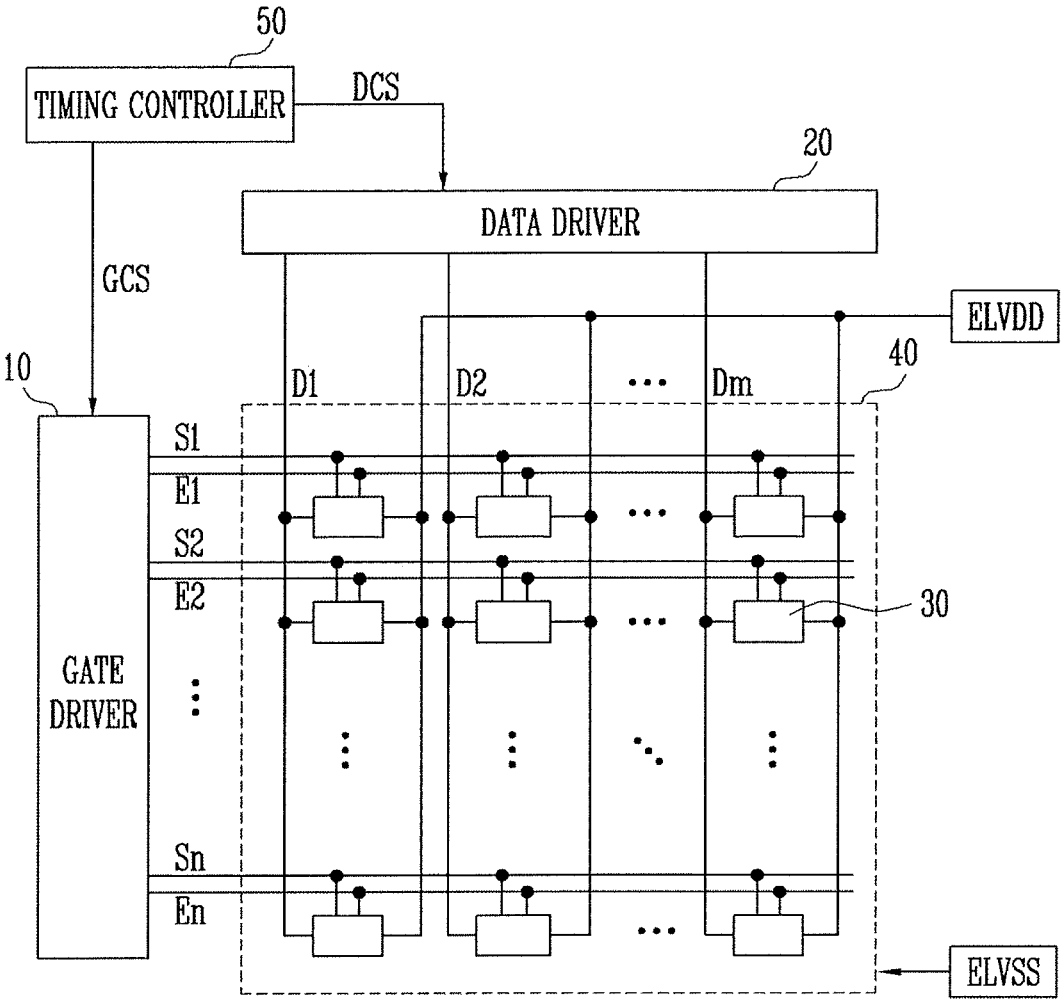
FIG. 1 illustrates an embodiment of an organic light emitting display device.

Example embodiments are described with reference to the drawings; however, they may be embodied in different forms and should not be construed as limited to the embodiments set forth herein. Rather, these embodiments are provided so that this disclosure will be thorough and complete, and will fully convey exemplary implementations to those skilled in the art. The embodiments (or portions thereof) may be combined to form additional embodiments.

In the drawings, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

When an element is referred to as being "connected" or "coupled" to another element, it can be directly connected or coupled to the another element or be indirectly connected or coupled to the another element with one or more intervening elements interposed therebetween. In addition, when an element is referred to as "including" a component, this indicates that the element may further include another component instead of excluding another component unless there is different disclosure.

FIG. 1 illustrates an embodiment of an organic light emitting display device which includes a gate driver 10, a data driver 20, a pixel unit 40, and a timing controller 50. The timing controller 50 generates a data driving control signal DCS and a gate driving control signal GCS based on synchronization signals from an external source. The data driving control signal DCS generated by the timing controller 50 is supplied to the data driver 20. The gate driving control signal GCS generated by the timing controller 50 is supplied to the data driver 10.

The data driving control signal DCS includes a source start signal and clock signals. The source start signal controls a sampling start time of data. The clock signals control a sampling operation.

The gate driving control signal GCS includes a scan start signal, an emission start signal, and clock signals. The scan start signal controls the first timing of the scan signal. The emission start signal controls the first timing of the emission control signal. The clock signals may be used to invert the scan start signal and emission start signal.

The gate driver 10 receives the gate driving control signal GCS from the timing controller 50. The gate driver 10 receiving the gate driving control signal GCS supplies a scan signal to scan lines S1 to Sn, and supplies an emission control signal to emission control lines E1 to En.

For example, the gate driver 10 may sequentially supply a scan signal to the scan lines S1 to Sn. When the scan signal is sequentially supplied to the scan lines S1 to Sn, the pixels 30 are selected in units of horizontal lines. Further, the gate driver 10 may sequentially supply an emission control signal to the emission control lines E1 to En. When the emission control signal is sequentially supplied to the emission control lines E1 to En, the pixels 30 do not emit light in units of horizontal lines. For example, a specific pixel 30 that receives the emission control signal is set to a non-emissive state during a period of a supply of the emission control signal and is set to an emissive state during other periods.

The emission control signal is set with a gate-off voltage (e.g., a low voltage) to turn off transistors in the pixels 30. The scan signal may be set with a gate-on voltage (e.g., a high voltage) to turn on transistors in the pixels 30.

The gate driver 10 includes a plurality of stages. Each stage may be connected to one of the scan lines S1 to Sn and one of the emission control lines E1 to En.

The data driver 20 receives the data driving control signal DCS from the timing controller 50. The data driver 20 supplies data signals to the data lines D1 to Dm based on the data driving control signal DCS. The data signals supplied to the data lines D1 to Dm are supplied to pixels 30 selected by the scan signal. The data driver 20 may supply the data signals to the data lines D1 to Dm in synchronization with the scan signal.

The pixel unit 40 includes the pixels 30 which are connected to the scan lines S1 to Sn, the data lines D1 to Dm, and the emission control lines E1 to En. The pixel unit 40 may receive a first driving power source ELVDD and a second driving power source ELVSS from an external source.

Each of the pixels 30 includes a driving transistor and an organic light emitting diode. The driving transistor controls the quantity of current flowing from the first driving power source ELVDD to the second driving power source ELVSS, via the organic light emitting diode, based on the data signal. In FIG. 1, n scan lines S1 to Sn and n emission control lines E1 to En are illustrated. In one embodiment, one or more dummy scan lines and dummy emission control lines may be additionally formed in the pixel unit 40 based on a circuit structure of the pixels 30.

Figure 2:
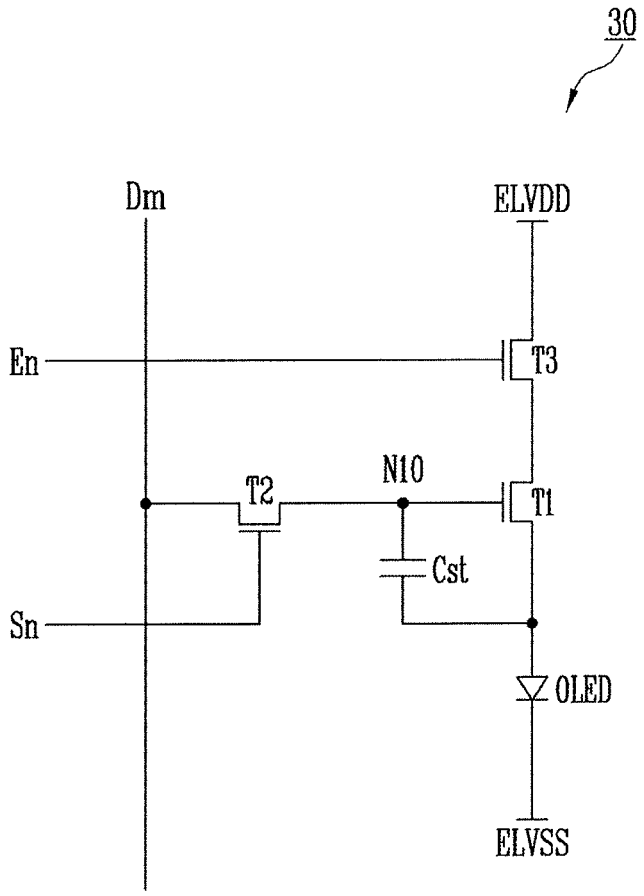
FIG. 2 illustrates an embodiment of a pixel.

FIG. 2 illustrates an embodiment of a pixel, which may be representative of the pixels 30 in FIG. 1. For illustrative purposes, the pixel in FIG. 2 is connected with an $n^{th}$ scan line Sn and an $m^{th}$ data line Dm.

Referring to FIG. 2. pixel 30 may include an organic light emitting diode OLED, a first transistor T1 (driving transistor). a second transistor T2, a third transistor T3, and a storage capacitor Cst. The organic light emitting diode OLED has an anode electrode connected to a second electrode of the first transistor T1 and a cathode electrode connected to the second driving power source ELVSS. The organic light emitting diode OLED may generate light with predetermined luminance based on the quantity of current from the first transistor T1.

The first transistor T1 has a first electrode connected to the first driving power source ELVDD via the third transistor T3, a second electrode connected to the anode electrode of the organic light emitting diode OLED, and a gate electrode connected to a tenth node N10. The first transistor T1 controls the quantity of current flowing from the first driving power source ELVDD to the second driving power source ELVSS, via the third transistor T3 and the organic light emitting diode OLED, based on a voltage of the tenth node N10.

The second transistor T2 includes a first electrode connected to the data line Dm, a second electrode connected to the tenth node N10, and a gate electrode connected to scan line Sn. The second transistor T2 is turned on when the scan signal is supplied to the scan line Sn, to supply the data signal supplied through the data line Dm to the tenth node N10.

The third transistor T3 includes a first electrode connected to the first driving power source ELVDD, a second electrode connected to the first electrode of the first transistor T1 , and a gate electrode connected to the emission control line En. The third transistor T3 is turned off when the emission control signal is supplied to the emission control line En and is turned on when the emission control signal is not supplied.

When the third transistor T3 is turned off, the first transistor T1 and the first driving power source ELVDD are electrically blocked. Thus, the pixel 30 is set in the non-emissive state. When the third transistor T3 is turned on, the first transistor T1 and the first driving power source ELVDD are electrically connected. Thus, the pixel 30 is set in the emissive state.

The storage capacitor Cst is connected between the tenth node N10 and the anode electrode of the organic light emitting diode OLED. The storage capacitor Cst stores a voltage of the tenth node N10.

The pixel 30 may have a different structure and operation in another embodiment. For example, the pixel 30 may be implemented in various circuit forms having a different number of transistors and/or capacitors and/or which operates based on an emission period is controllable by the emission control signal.

Figure 3:
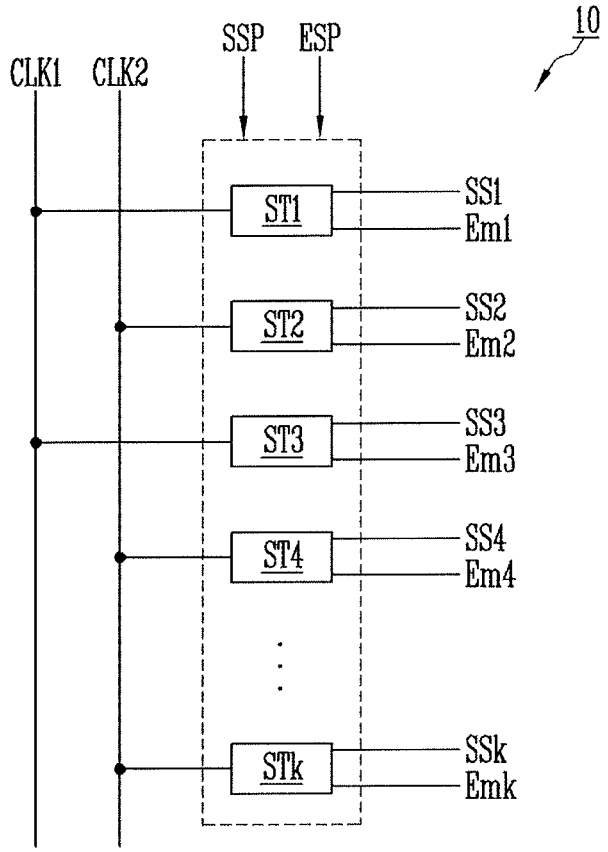
FIG. 3 illustrates an embodiment of a gate driver.

FIG. 3 illustrates an embodiment of the gate driver 10 in FIG. 1. Referring to FIG. 3, the gate driver 10 includes k stages ST1 to STk, where k is a natural number. Each of the stages ST1 to STk generates a scan signal SS and an emission control signal Emi based on a first clock signal CLK1 or a second clock signal CLK2.

The gate driver 10 receives a scan start signal SSP and an emission start signal ESP from the timing controller 50. The scan start signal SSP controls the first timing of the scan signal. The emission start signal ESP controls the first timing of the emission control signal. The scan start signal SSP and the emission start signal ESP may be supplied to the first stage ST1.

Each of the stages ST1 to STk is connected to any one scan line S and emission control line E. A scan signal SSi and emission control signal Emi generated in an $i^{th}$ stage STi (i is a natural number smaller than k) may be supplied to the scan line S and the emission control line E in different horizontal lines. For example, the $i^{th}$ scan line SS1 may be supplied to the $i^{th}$ scan line Si, and the $i^{th}$ emission control line EMi may be supplied to the $i+2^{th}$ emission control line Ei+2. For example, the $i^{th}$ scan line SSi and the $i^{th}$ emission control signal Emi may be supplied to the scan line S and the emission control line E in different horizontal lines based on the circuit structure of the pixel 30.

The odd (or even) numbered stages ST1, ST3, . . . receive the first clock signal CLK1. The even (or odd) numbered stages ST2, ST4, . . . receive the second clock signal CLK2. The first clock signal CLK1 and the second clock signal CLK2 may be set to have the same period and inverted phases.

Figure 4:
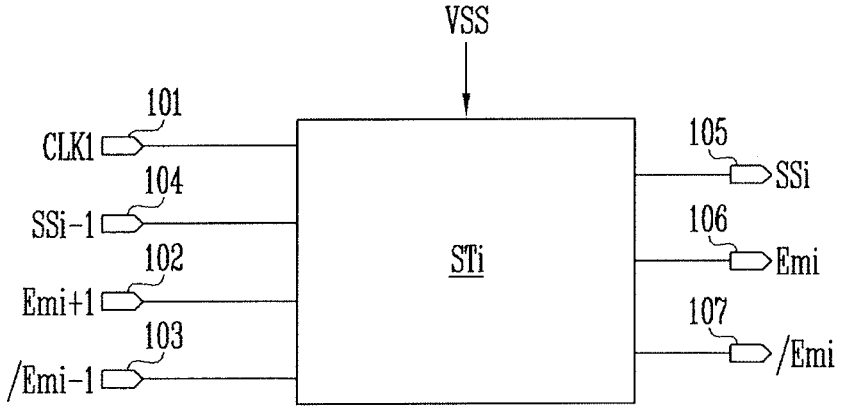
FIG. 4 illustrates an embodiment of a stage.

FIG. 4 illustrates an embodiment of the stage in FIG. 3. For illustrative purposes, the $i^{th}$ stage STi is illustrated, and it is assumed that the $i^{th}$ stage is the odd-numbered stage that receives the first clock signal CLK1.

Referring to FIG. 4, the $i^{th}$ stage STi includes a first input terminal 101, a second input terminal 102, a third input terminal 103, a fourth input terminal 104, a first output terminal 105, a second output terminal 106, and a third output terminal 107. The first input terminal 101 receives the first clock signal CLK1. The second clock signal CLK2 is supplied to the first input terminal 101 of the $i+1^{th}$ stage STi+1.

The second input terminal 102 receives an emission control signal Emi+1 of the next stage STi+1.

The third input terminal 103 receives an inverted emission control signal /Emi−1 of the previous stage STi−1. When the $i^{th}$ stage STi is set as the first stage, the emission start signal ESP is supplied to the third input terminal 103. The emission start signal ESP may be set to have, for example, the width of one period or more of the first clock signal CLK1. Then, the emission control signal corresponding to the emission start signal ESP may also be set to have, for example, the width of one period or more of the first clock signal CLK1.

The fourth input terminal 104 receives a scan signal SSi−1 from the stage STi−1. When the $i^{th}$stage STi is the first stage, the scan start signal SSP is supplied to the fourth input terminal 104. The scan start signal SSP may have a width less than one period of the first clock signal CLK1. Then, the scan signal corresponding to the scan start signal SSP may also have a width less than one period of the first clock signal.

The first output terminal 105 outputs a scan signal SSI. The scan signal SSi supplied to the first output terminal 105 is supplied to the scan line S electrically connected with the first output terminal 105. The scan signal SSi output to the first output terminal 105 is supplied to the fourth input terminal 104 of the next stage STi+1.

The second output terminal 106 outputs an emission control signal Emi. The emission control signal Emi supplied to the second output terminal 106 is supplied to the emission control line E electrically connected with the second output terminal 106. The emission control signal Emi output to the second output terminal 106 is supplied to the second input terminal 102 of the previous stage STi−1.

The third output terminal 107 outputs an inverted emission control signal /Emi. The inverted emission control signal /Emi may correspond to a signal obtained by inverting the emission control signal Emi. The inverted emission control signal /Emi output to the third input terminal 103 is supplied to the third input terminal 103 of the next stage STi+1. The stage STi receives a first power source VSS, which may have, for example, a gate-off voltage (e.g., a low voltage).

Figure 5:
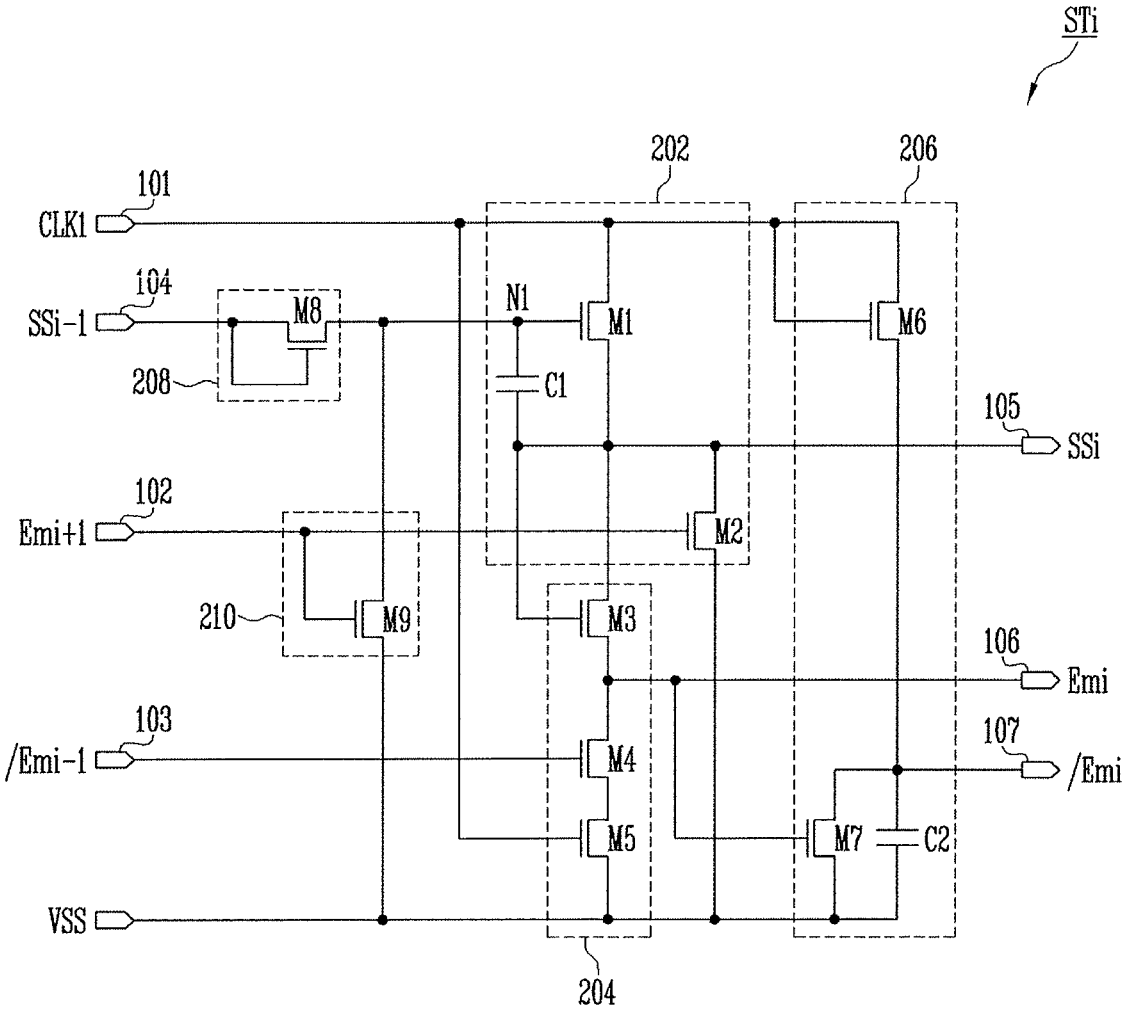
FIG. 5 illustrates another embodiment of a stage.

FIG. 5 illustrates another embodiment of a stage, which, for example, may be a more detailed version of the stage STi in FIG. 4. Referring to FIG. 5, the stage STi includes a first output unit 202, a second output unit 204, a third output unit 206, a first signal processing unit 208, and a second signal processing unit 210. Each of the first output unit 202, the second output unit 204, the third output unit 206, the first signal processing unit 208, and the second signal processing unit 210 may be formed of NMOS transistors based on the pixel 30 formed of the NMOS transistors T1 to T3.

The first output unit 202 supplies the scan signal SSi to the first output terminal 105 based on the signals supplied to the first input terminal 101 and the second input terminal 102 and a voltage of a first node N1. The first output unit 202 includes a first transistor M1, a second transistor M2, and a first capacitor C1.

The first transistor M1 is connected between the first input terminal 101 and the first output terminal 105. A gate electrode of the first transistor M1 is connected to the first node N1. The first transistor M1 is turned on or turned off based on the voltage of the first node N1.

The second transistor M2 is connected between the first output terminal 105 and the first power source VSS. A gate electrode of the second transistor M2 is connected to the second input terminal 102. The second transistor M2 is turned off when the $i+1^{th}$ emission control signal Emi+1 is supplied to the second input terminal 102, and is turned on in other cases.

The first capacitor C1 is connected between the first node N1 and the first output terminal 105. The first capacitor C1 stores the voltage of the first node N1 and serves as a boosting capacitor for increasing the voltage of the first node N1 based on a voltage of the first output terminal 105. The voltage of the first node N1 is increased based on the voltage of the first output terminal 105. Thus, the first transistor M1 is stably maintained in the turn-on state.

The second output unit 204 is connected to the first power source VSS and supplies the emission control signal Emi to the second output terminal 106 based on the signals supplied to the first input terminal 101, the third input terminal 103, and the first output terminal 105. The second output unit 204 includes a third transistor M3, a fourth transistor M4, and a fifth transistor M5.

The third transistor M3 is connected between the first output terminal 105 and the second output terminal 106. A gate electrode of the third transistor M3 is connected to the first output terminal 105. The third transistor M3 is connected in the form of a diode and supplies the voltage of first output terminal 105 to second output terminal 106.

The fourth transistor M4 and the fifth transistor M5 are serially connected between the second output terminal 106 and the first power source VSS. A gate electrode of the fourth transistor M4 is connected to the third input terminal 103. The fourth transistor M4 is turned on when the $i-1^{th}$ inverted emission control signal /Emi−1 is supplied to the third input terminal 103, and is turned off in other cases.

The fifth transistor M5 has a gate electrode connected to the first input terminal 101. The fifth transistor M5 is turned on when the first clock signal CLK1 is supplied to the first input terminal 101 and is turned off in other cases.

The third output unit 206 is connected to the first power source and supplies the inverted emission control signal /Emi to the third output terminal 107 based on the signals supplied to the first input terminal 101 and the second output terminal 106. The third output unit 206 includes a sixth transistor M6, a seventh transistor M7, and a second capacitor C2.

The sixth transistor M6 is connected between the first input terminal 101 and the third output terminal 107. A gate electrode of the sixth transistor M6 is connected to the first input terminal 101. The sixth transistor M6 is connected in the form of a diode and supplies the voltage of the first input terminal 101 to the third output terminal 107.

The seventh transistor M7 is connected between the third output terminal 107 and first power source VSS. The seventh transistor M7 has a gate electrode connected to the second input terminal 106. The seventh transistor M7 is turned on or turned off based on a voltage of the second output terminal 106.

The second capacitor C2 is connected between the third output terminal 107 and the first power source VSS.

The first signal processing unit 208 controls the voltage of the first node N1 based on a signal supplied to the fourth input terminal 104. The first signal processing unit 208 includes an eighth transistor M8.

The eighth transistor M8 is connected between the fourth input terminal 104 and the first node N1. The eighth transistor M8 has a gate electrode connected to the fourth input terminal 104. The eighth transistor M8 is connected in the form of a diode and supplies the voltage of the fourth input terminal 104 to the first node N1.

The second signal processing unit 210 controls the voltage of the first node N1 based on a signal supplied to the second input terminal 102. The second signal processing unit 210 includes a ninth transistor M9.

The ninth transistor M9 is connected between the first node N1 and the first power source VSS. The ninth transistor M9 has a gate electrode connected to the second input terminal 102. The ninth transistor M9 is turned off when the $i+1^{th}$ emission control signal Emi+1 is supplied to the second input terminal 102 and is turned on in other cases.

The remaining stages may be implemented with the same circuit as $i^{th}$ stage STi.

Figure 6:
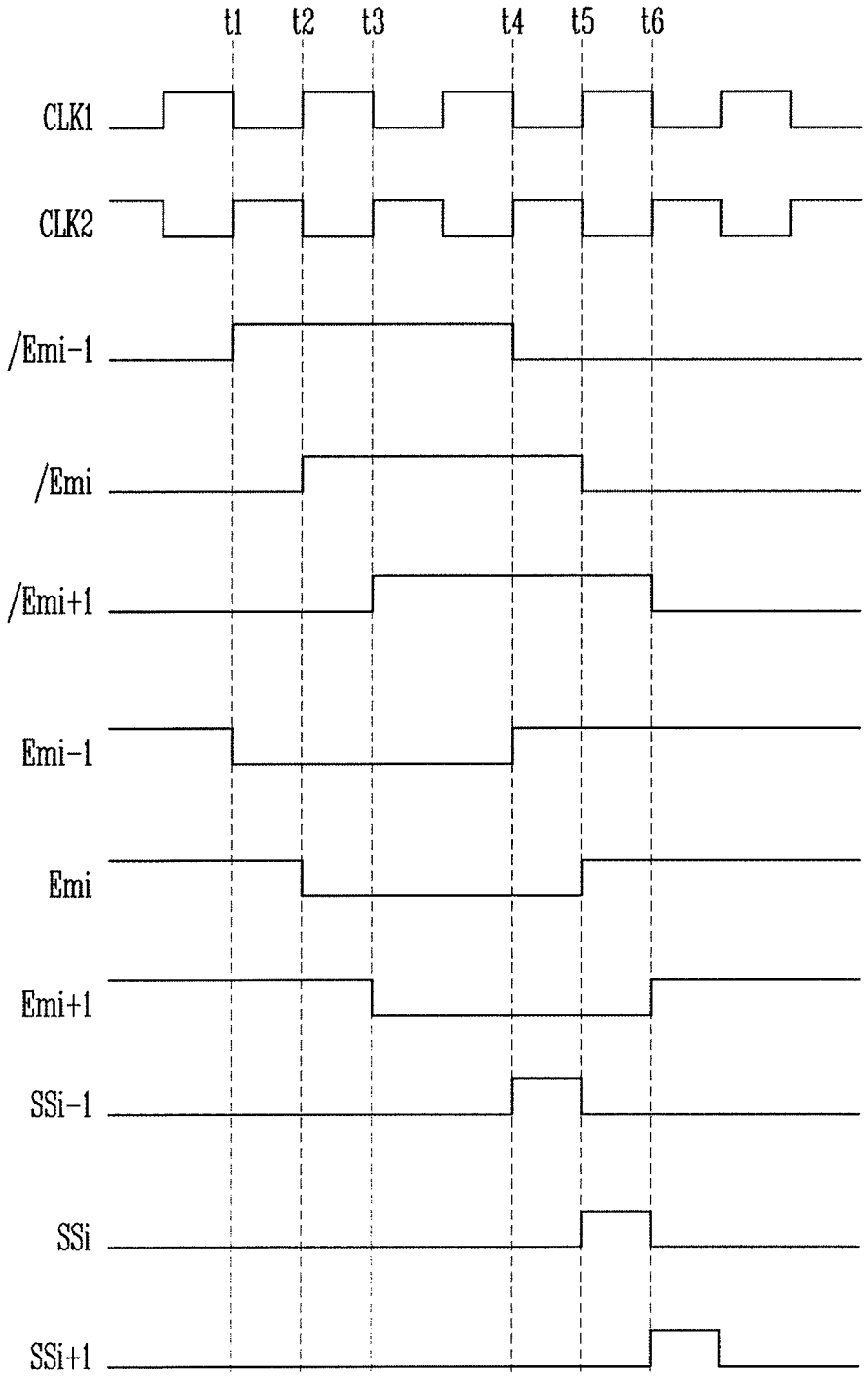
FIG. 6 illustrates waveforms corresponding to an embodiment of a method for driving a stage.

FIG. 6 illustrates a waveform corresponding to an embodiment of a method for driving a stage, for example, as illustrated in FIG. 5. Referring to FIG. 6, the first clock signal CLK1 and the second clock signal CLK2 may be set to have the same period and inverted phases. When the first clock signal CLK1 (or the second clock signal CLK2) is supplied to the first input terminal 101, the first input terminal 101 may be set with the gate-on voltage. When the first clock signal CLKI (or the second clock signal CLK2) is not supplied to the first input terminal 101, the first input terminal 101 may be set with the gate-off voltage, for example, a voltage of the first power source VSS.

When the $i+1^{th}$ emission control signal Emi+1 is supplied to the second input terminal 102, the second input terminal 102 is set with the gate-off voltage and is set with the gate-on voltage in other cases.

When the $i-1^{th}$ inverted emission control signal /Emi−1 is supplied to the third input terminal 103, the third input terminal is set with the gate-on voltage and is set with the gate-off voltage in other cases.

When the $i-1^{th}$ scan signal SSi−1 is supplied to the fourth input terminal 104, the fourth input terminal 104 is set with the gate-on voltage and is set with the gate-off voltage in other cases.

In operation, first, the $i-1^{th}$ inverted emission control signal /Emi−1 is supplied to the third input terminal 103 at a first time t1. When the $i^{th}$ stage STi is set as the first stage, the emission start signal ESP is supplied to the third input terminal 103. When the $i-1^{th}$ inverted emission control signal /Emi−1 is supplied to the third input terminal 103, the fourth transistor M4 is turned on. The fourth transistor M4 maintains a turn-on state during a period, between the first time t1 and the fourth time t4, during which the $i-1^{th}$ inverted emission control signal /Emi−1 is supplied. When the fourth transistor M4 is turned on, the fifth transistor M5 and the second output terminal 106 are electrically connected. Since the fifth transistor M5 is set in the turn-off state, the second output terminal 106 maintains a voltage of a previous period.

At a second time t2, the first clock signal CLK1 is supplied to the first input terminal 101. When the first clock signal CLK1 is supplied to the first input terminal 101, the fifth transistor M5 and the sixth transistor M6 are turned on.

When the fifth transistor M5 is turned on, the voltage of the first power source VSS is supplied to the second output terminal 106. The voltage of the first power source VSS supplied to the second output terminal 106 is supplied to a specific emission control line as the emission control signal Emi. When the first power source VSS is supplied to the second output terminal 106, the seventh transistor M7 is turned off.

When the sixth transistor M6 is turned on, the first clock signal CLK1 is supplied to the third output terminal 107. The third output terminal 107 outputs a high voltage, e.g., an inverted emission control signal /Emi. The voltage of the first clock signal CLK1 supplied to third output terminal 107 is stored in the second capacitor C2.

At a third time t3, the supply of the first clock signal CLK1 to the first input terminal 101 is stopped. When the first clock signal CLK1 is stopped, the fifth transistor M5 and the sixth transistor M6 are turned off.

When the fifth transistor M5 is turned off, an electric connection of the fourth transistor M4 and the first power source VSS is blocked. The second output terminal 106 maintains a voltage of a previous period.

The second output terminal 106 is electrically connected with the emission control line. The emission control line is formed in the pixel unit 40 in a horizontal direction and includes a parasitic capacitor. Accordingly, at the third time t3, the first output terminal 106 maintains the voltage of the previous period (e.g., the voltage of the first power source VSS) by the parasitic capacitor of the emission control line.

When the sixth transistor M6 is turned off, an electric connection of the first input terminal 101 and the third output terminal 107 is blocked. The third output terminal 107 maintains the voltage of the previous period by the second capacitor C2. The third output terminal 107 outputs a voltage of the inverted emission control signal /Emi.

At the third time t3, the $i+1^{th}$ emission control signal Emi+1 is supplied to the second input terminal 102. When the $i+1^{th}$ emission control signal Emi+1 is supplied to the second input terminal 102, the second transistor M2 is turned off. Then, an electric connection between the first output terminal 105 and first power source VSS is blocked.

At a fourth time t4, the $i-1^{th}$ scan signal SSi−1 is supplied to the fourth input terminal 104 and the supply of the $i-1^{th}$ inverted emission control signal /Emi−1 to the third input terminal 103 is stopped. When the supply of the $i-1^{th}$ inverted emission control signal /Emi−1 is stopped, the fourth transistor M4 is turned off. When the $i-1^{th}$ scan signal SSi−1 is supplied to the fourth input terminal 104, the eighth transistor M8 is turned on.

When the eighth transistor M8 is turned on, a voltage of the $i-1^{th}$ scan signal SSi−1 (e.g., a high voltage) is supplied to the first node N1. When the high voltage is supplied to the first node N1, the first transistor M1 is turned on. Since the first clock signal CLK1 is not supplied to the first output terminal 101, the first output terminal 105 maintains the voltage of the previous period. The high voltage supplied to the first node N1 is stored in the first capacitor C1. Accordingly, the first transistor M1 maintains the turn-on state.

At a fifth time t5, the first clock signal CLK1 is supplied to the first input terminal 101. When the first clock signal CLK1 is supplied to the first input terminal 101, the fifth transistor M5 and the sixth transistor M6 are turned on. Then, the first transistor M1 maintains the turn-on state by the voltage charged in the first capacitor C1 at the fifth time t5.

Since the first transistor M1 is set in the turn-on state, the first clock signal CLK1 supplied to the first input terminal 101 is supplied to the first output terminal 105. The first clock signal CLK1 supplied to the first output terminal 105 is supplied to the scan line connected with the first output terminal 105 as the scan signal SSi. When the first clock signal CLK1 is supplied to the first output terminal 105, the voltage of the first node N1 is increased by the boosting of the first capacitor C1. Accordingly, the first transistor M1 stably maintains the turn-on state.

When the first clock signal CLK1 is supplied to the first input terminal 105, the third transistor M3 is turned on.

When the third transistor M3 is turned on, the voltage of the first clock signal CLK1 is supplied to the second output terminal 106. Then, the supply of the emission control signal Emi to the second output terminal 106 is stopped. Further, when the voltage of the first clock signal CLK1 is supplied to the second output terminal 106, the seventh transistor M7 is turned on.

When the seventh transistor M7 is turned on, the voltage of the first power source VSS is supplied to the third output terminal 107. Then, the supply of the inverted emission control signal /Emi to the third output terminal 107 is stopped. Further, the first clock signal CLK1 supplied to the third output terminal 107 by the turn-on of the sixth transistor M6 is supplied to the first power source VSS via the seventh transistor M7. As a result, the third output terminal 107 stably maintains the voltage of the first power source VSS.

The first clock signal CLK1 is supplied to the third output terminal 107 via the sixth transistor M6, which is connected in the form of a diode. Then, the first power source VSS is supplied to the third output terminal 107 via the seventh transistor M7, which is set in the turn-on state. Even though W/L of the sixth transistor M6 and the seventh transistor M7 are similarly set, the third output terminal 107 is set with the voltage of the first power source VSS.

At a sixth time t6, the $i+1^{th}$ emission control signal Emi+1 is stopped. When the supply of the $i+1^{th}$ emission control signal Emi+1 to the second input terminal 102 is stopped, the second transistor M2 and the ninth transistor M9 are turned on. When the second transistor M2 is turned on, the voltage of the first power source VSS is supplied to the first output terminal 105, and supply of the scan signal SSi to the first output terminal 105 is stopped.

When the ninth transistor M9 is turned on, the voltage of the first power source VSS is supplied to the first node N1. When the voltage of the first power source VSS is supplied to the first node N1, the first transistor M1 is set in the turn-off state. Then, the first capacitor C1 stores the voltage of the first node N1.

The stages ST1 to STk may output the scan signal SS and the emission control signal Emi in accordance with the aforementioned process. For example, the i+1th stage STi may output the scan signal SSi+1 and the emission control signal Emi+1 while repeating the aforementioned process based on the second clock signal CLK2.

In addition, the stages ST1 to STk may control the width of the emission control signal based on the width of the emission start signal ESP. In this case, the $i-1^{th}$ inverted emission control signal /Emi−1 may be, for example, the emission start signal ESP.

When the width of the emission start signal ESP is increased, the width between the time t1 to the time t4 is increased. Then, the width of the emission control signal Emi is increased based on the emission start signal ESP. For example, in stages ST1 to STk, the width of the emission control signal is controlled based on the width of the emission start signal ESP. Thus, it is possible to freely control emission times of the pixels 30 based on the width of the emission start signal ESP.

The methods, processes, and/or operations described herein may be performed by code or instructions to be executed by a computer, processor, controller, or other signal processing device. The computer, processor, controller, or other signal processing device may be those described herein or one in addition to the elements described herein. Because the algorithms that form the basis of the methods (or operations of the computer, processor, controller, or other signal processing device) are described in detail, the code or instructions for implementing the operations of the method embodiments may transform the computer, processor, controller, or other signal processing device into a special-purpose processor for performing the methods herein.

The processors, drivers, controllers, and other processing features of the disclosed embodiments may be implemented in logic which, for example, may include hardware, software, or both. When implemented at least partially in hardware, the processors, drivers, controllers, and other processing features may be, for example, any one of a variety of integrated circuits including but not limited to an application-specific integrated circuit, a field-programmable gate array, a combination of logic gates, a system-on-chip, a microprocessor, or another type of processing or control circuit.

When implemented in at least partially in software, the processors, drivers, controllers, and other processing features may include, for example, a memory or other storage device for storing code or instructions to be executed, for example, by a computer, processor, microprocessor, controller, or other signal processing device. The computer, processor, microprocessor, controller, or other signal processing device may be those described herein or one in addition to the elements described herein. Because the algorithms that form the basis of the methods (or operations of the computer, processor, microprocessor, controller, or other signal processing device) are described in detail, the code or instructions for implementing the operations of the method embodiments may transform the computer, processor, controller, or other signal processing device into a special-purpose processor for performing the methods herein.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the present invention as set forth in the following claims.

What is claimed is:

1. A stage, comprising:

a first output to supply a scan signal to a first output terminal based on a signal supplied to a first input terminal, a signal supplied to a second input terminal, and a voltage of a first node;

a second output, connected to a first power source, to supply an emission control signal to a second output terminal based on signals supplied to the first input terminal, the first output terminal, and a third input terminal;

a third output, connected to the first power source, to supply an inverted emission control signal to a third output terminal based on signals supplied to the first input terminal and the second output terminal;

a first signal processor to control a voltage of the first node based on a signal supplied to a fourth input terminal; and a second signal processor to control the voltage of the first node based on the signal supplied to the second input terminal.

2. The stage as claimed in claim 1, wherein the first power source is to have a gate-off voltage.

3. The stage as claimed in claim 1, wherein:

the first input terminal is to receive a first clock signal, and the emission control signal has a width of one or more periods of the first clock signal.

4. The stage as claimed in claim 3, wherein the scan signal has a width less than one period of the first clock signal and is to have a gate-on voltage.

5. The stage as claimed in claim 1, wherein:

the inverted emission control signal has an inverted form of the emission control signal, and when the emission control signal has a gate-off voltage, the inverted emission control signal has a gate-on voltage.

6. The stage as claimed in claim 1, wherein:

the second input terminal is to receive an emission control signal of a next stage, the third input terminal is to receive an emission start signal or an inverted emission control signal of a previous stage, and the fourth input terminal is to receive a scan start signal or a scan signal of a previous stage.

7. The stage as claimed in claim 1, wherein the first output includes:

a first transistor connected between the first input terminal and the first output terminal, the first transistor including a gate electrode connected to the first node;

a second transistor connected between the first output terminal and the first power source, the second transistor including a gate electrode connected to the second input terminal; and a first capacitor connected between the first node and the first output terminal.

8. The stage as claimed in claim 1, wherein the second output includes:

a third transistor connected between the first output terminal and the second output terminal, the third transistor including a gate electrode connected to the first output terminal; and a fourth transistor and a fifth transistor serially connected between the second output terminal and the first power source, a gate electrode of the fourth transistor is connected to the third input terminal, and a gate electrode of the fifth transistor is connected to the first input terminal.

9. The stage as claimed in claim 1, wherein the third output includes:

a sixth transistor connected between the first input terminal and the third output terminal, the sixth transistor including a gate electrode connected to the first input terminal;

a seventh transistor connected between the third output terminal and the first power source, the seventh transistor including a gate electrode connected to the second output terminal; and a second capacitor connected between the third output terminal and the first power source.

10. The stage as claimed in claim 1, wherein:

the first signal processor includes an eighth transistor connected between the fourth input terminal and the first node, and the eighth transistor including a gate electrode connected to the fourth input terminal.

11. The stage as claimed in claim 1, wherein:

the second signal processor includes a ninth transistor connected between the first node and the first power source, and the ninth transistor including a gate electrode connected to the second input terminal.

12. The stage as claimed in claim 1, wherein:

each of the first output, the second output, the third output, the first signal processor, and the second signal processor includes at least one NMOS transistor.

13. An organic light emitting display device, comprising:

a plurality of pixels connected with scan lines, data lines, and emission control lines;

a data driver to supply data signals to the data lines; and a gate driver including a plurality of stages to supply a scan signal to the scan lines and an emission control signal to the emission control lines, wherein each of the stages includes:

a first output to supply a scan signal to a first output terminal based on a signal supplied to a first input terminal, a signal supplied to a second input terminal, and a voltage of a first node;

a second output, connected to a first power source, to supply an emission control signal to a second output terminal based on signals supplied to the first input terminal, the first output terminal, and a third input terminal;

a third output, connected to the first power source, to supply an inverted emission control signal to a third output terminal based on signals supplied to the first input terminal and the second output terminal;

a first signal processor to control a voltage of the first node based on a signal supplied to a fourth input terminal; and a second signal processor to control the voltage of the first node based on the signal supplied to the second input terminal, and wherein the first power source is to have a gate-off voltage.

14. The organic light emitting display device as claimed in claim 13, wherein:

a first clock signal is to be supplied to the first input terminals of the stages in one or more odd numbered horizontal lines, and a second clock signal is to be supplied to the first input terminals of the stages in one or more even numbered horizontal lines.

15. The organic light emitting display device as claimed in claim 14, wherein the first clock signal and the second clock signal have the same period and inverted phases.

16. The organic light emitting display device as claimed in claim 13, wherein:

the second input terminal is to receive an emission control signal of a next stage, the third input terminal is to receive an emission start signal or an inverted emission control signal of a previous stage, and the fourth input terminal is to receive a scan start signal or a scan signal of a previous stage.

17. The organic light emitting display device as claimed in claim 13, wherein the first output includes:

a first transistor connected between the first input terminal and the first output terminal, the first transistor including a gate electrode connected to the first node;

a second transistor connected between the first output terminal and the first power source, the second transistor including a gate electrode connected to the second input terminal; and a first capacitor connected between the first node and the first output terminal.

18. The organic light emitting display device as claimed in claim 13, wherein the second output includes:

a third transistor connected between the first output terminal and the second output terminal, the third transistor including a gate electrode connected to the first output terminal; and a fourth transistor and a fifth transistor serially connected between the second output terminal and the first power source, a gate electrode of the fourth transistor is connected to the third input terminal, and a gate electrode of the fifth transistor is connected to the first input terminal.

19. The organic light emitting display device as claimed in claim 13, wherein the third output includes:

a sixth transistor connected between the first input terminal and the third output terminal, the sixth transistor including a gate electrode connected to the first input terminal;

a seventh transistor connected between the third output terminal and the first power source, the seventh transistor including a gate electrode connected to the second output terminal; and a second capacitor connected between the third output terminal and the first power source.

20. The organic light emitting display device as claimed in claim 13, wherein:

the first signal processor includes an eighth transistor connected between the fourth input terminal and the first node, the eighth transistor including a gate electrode connected to the fourth input terminal, and the second signal processor includes a ninth transistor connected between the first node and the first power source, the ninth transistor including a gate electrode connected to the second input terminal.

* * * * *